US010624405B2

(12) United States Patent
Shida et al.

(10) Patent No.: US 10,624,405 B2
(45) Date of Patent: Apr. 21, 2020

(54) AERODYNAMIC CONTROL DEVICE AND HELMET INCLUDING THE SAME

(71) Applicant: SHOEI CO., LTD., Tokyo (JP)

(72) Inventors: Masayuki Shida, Tokyo (JP); Eiji Isobe, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 257 days.

(21) Appl. No.: 15/242,616

(22) Filed: Aug. 22, 2016

(65) Prior Publication Data

US 2017/0055620 A1 Mar. 2, 2017

(30) Foreign Application Priority Data

Sep. 1, 2015 (JP) ..... 2015-172250

(51) Int. Cl.

| | |
|---|---|
| ***A42B 3/04*** | (2006.01) |
| ***A42B 3/06*** | (2006.01) |
| ***A42B 3/22*** | (2006.01) |

(52) U.S. Cl.

CPC ..... *A42B 3/0493* (2013.01); *A42B 3/066* (2013.01); *A42B 3/22* (2013.01)

(58) Field of Classification Search

CPC ..... A42B 3/0493; A42B 3/066; A42B 3/22

See application file for complete search history.

(56) References Cited

U.S. PATENT DOCUMENTS

| | | | | |
|---|---|---|---|---|
| 5,996,128 | A | 12/1999 | Yanagihara | |
| 6,263,513 | B1 | 7/2001 | Murakami | |
| 2004/0158914 | A1 | 8/2004 | Tanaka | |
| 2014/0298570 | A1* | 10/2014 | Cobb | A42B 3/0493 2/410 |

FOREIGN PATENT DOCUMENTS

| | | |
|---|---|---|
| JP | H0616431 | 3/1994 |
| JP | 4311691 | 8/2009 |
| WO | 0024278 | 5/2000 |

OTHER PUBLICATIONS

"Search Report of Europe Counterpart Application", dated Jan. 13, 2017, p. 1-p. 7.

Office Action of Japan Counterpart Application, with English translation thereof, dated Nov. 13, 2018, pp. 1-8.

* cited by examiner

*Primary Examiner* — Anna K Kinsaul

(74) *Attorney, Agent, or Firm* — JCIPRNET

(57) ABSTRACT

An aerodynamic control device includes a void opening. The void opening decreases a resistance of a turbulence generated by a component part located behind a center of a longitudinal width of a helmet and is formed so that one end is connected to the helmet and the other end protrudes backward from the helmet.

14 Claims, 12 Drawing Sheets

| EXISTENCE OF AERODYNAMIC CONTROL DEVICE | EXISTENCE OF COWL | HEADING ANGLE | DRAG (g) | DIFFERENCE (g) | LIFT (g) | DIFFERENCE (g) | YAWING (g) | DIFFERENCE (g) |
|---|---|---|---|---|---|---|---|---|
| NON-EXISTENCE OF AERODYNAMIC CONTROL DEVICE | EXISTENCE OF COWL | 21.1° | 1587 | - | 2366 | - | 261 | - |
| EXISTENCE OF AERODYNAMIC CONTROL DEVICE | NON-EXISTENCE OF COWL | 21.1° | 1488 | -99 | 2234 | -132 | 201 | -60 |

<EXPERIMENT CONDITION>

- EXPERIMENT DEVICE EQUIPPED WITH ROBOT SUPPORTING VEHICLE BODY OF MOTORCYCLE, MANNEQUIN, AND HUMAN HEAD
- MEASUREMENT FOR FORCE APPLIED ONLY TO HUMAN HEAD SHAPE ABOVE NECK
- WIDTH SPEED OF 160km/h (44.4 m/s)
- STANDARD AIR
  ATMOSPHERIC PRESSURE OF 1013.25hPa
- TEMPERATURE OF 20℃
- CORRECTION FOR HUMIDITY OF 40%
- OBTAIN 3000 LOGS BY MEASURING THREE COMPONENT FORCES FOR 300 SECONDS AND OBTAIN AVERAGE VALUE

FIG. 12

AERODYNAMIC CONTROL DEVICE AND HELMET INCLUDING THE SAME

CROSS-REFERENCE TO RELATED APPLICATION

This application claims the priority benefit of Japan application serial no. 2015-172250, filed on Sep. 1, 2015. The entirety of the above-mentioned patent application is hereby incorporated by reference herein and made a part of this specification.

BACKGROUND OF THE INVENTION

Field of the Invention

The present invention relates to an aerodynamic control device and a helmet including the same.

Description of the Related Art

The present invention relates to an aerodynamic control device having a void opening attached to a helmet worn by a motorcycle rider and a helmet including the same.

The motorcycle riders are obliged to wear a helmet in the viewpoint of protecting a head portion in the event of an accident. Particularly, in a super high speed riding, such as Road Racing World Championship Grand Prix which is the top class category in the motorcycle road races as well as the motor sports by motorcycles, a careless movement of a helmet may distract the attention of a rider from his riding in the race. In order to ride the motorcycle at the higher speed, the aerodynamics of the helmet is also important as well as the aerodynamics of the motorcycle.

FIG. 1 diagrams the aerodynamic forces acting on the helmeted rider in his driving of the motorcycle. FIG. 1 also diagrams a relationship among drag, lift, and side force acting on the helmeted rider.

The forces acting on the helmeted rider are generally classified into three components, which are the aerodynamic pressure (drag) acted from the front side of the motorcycle, the side force caused by a crosswind, and the aerodynamic lift raising the helmet. Particularly, the drag (Drag: X) pressing the helmet from the front side of the motorcycle, the lift (Lift: Z) raising the helmet up, and the side force (Yawing: Y) acted on the helmet in the lateral direction (the rotation direction), become stronger as the motorcycle travels faster than the common driving on the public road.

The drag can be defined as the pressure caused by a fluid flowing in the opposite direction to the traveling direction of the motorcycle. That is, the drag can be defined as air resistance and hence is expressed as the resisting force which acts on the traveling motorcycle so as to drag it backward and disturbs the progress movement of it. Thus, a load of the drag applied to the neck portion of the rider becomes bigger as the drag becomes stronger, that is, the air resistance of the helmet increases and hence the drag causes the rider to be tired.

The side force can be defined as the force which rolls the helmet from side to side (Yawing) caused by the wind blowing from the lateral side of the motorcycle or generated when passing through a large oncoming vehicle. Such a side force affects the entire helmet worn by the rider and hence may cause considerable risk in some cases.

The lift can be defined as the force which acts in the direction perpendicular to the traveling direction of the motorcycle so as to raise the helmet up in the air. When the helmet is going to be raised from the rider's head due to the act of the lift, the attention of the rider is distracted and hence the rider may lose a driving stability in some cases.

The helmet worn by the motorcycle rider has been considered that the air resistance can be decreased as long as the helmet shape is generally streamline in order to suppress the air pressure (drag) as much as possible. When the helmet shape becomes a streamline one, the coefficient of air resistance air resistance becomes smaller, but it is problem that the lift increases so that the helmet is raised up. Thus, the current helmets have a tendency excessively that the helmet becomes a streamline shape in order to decrease the air pressure, and a rear spoiler is attached to a rear portion of the helmet in order to generate a down force which counteracts a lift, as well.

Japanese Patent No. 4311691 discloses a helmet in which a pair of wake stabilizers 10 having a flat side rectification surface 15 are symmetrically bilaterally disposed on a rear stream portion 9 of the shell, and a rear spoiler 12 is provided from a top portion 11 to a rear surface of the shell on the helmet 1, as well, in order to prevent the helmet 1 from being swung right and left and stabilize it in the wind (air stream) having a higher relative speed. Here, the wake stabilizer 10 guides the winds (air streams) flowing along both left and right side surfaces of the helmet 1 along the side rectification surface 15 to a rear position separated from the helmet 1 as much as possible. Further, the rear spoiler 12 suppresses the turbulence vortex or Karman vortex generated by the wind (air stream) flowing over the top portion of the helmet 1.

However, there is a limitation on the effect of decreasing the drag, the lift, and the side force at a high-speed traveling by the former rear spoiler attached to the rear surface of the helmet. Besides, as mentioned above, in a super high speed race, such as Road Racing World Championship Grand Prix, it is feared that the mild swing of the helmet may cause a large accident. Thus, there is an actual desire for an aerodynamic control device having higher aerodynamic performance and a helmet including the same.

Further, the wake stabilizer disclosed in Japanese Patent No. 4311691 can also prevent the helmet from being swung left and right to some extent against the wind (air stream) having a higher relative speed. Particularly, even a slight swing of the helmet is very dangerous in some races at a speed exceeding 300 km/h. Thus, the helmet which ensures safer and faster driving becomes an important article for a rider.

However, the flowing direction or the strength of the traveling winds acting on the helmet are substantially changed in accordance with the presence or not, the shape or, the size of the cowl (wind guard) equipped with the motorcycle with the intention of decreasing the air resistance or protecting the rider from the traveling winds. Since the function device, that is the wake stabilizer disclosed in Japanese Patent No. 4311691, is provided integrally as a part of the area forming the rear spoiler for suppressing the side force, when the motorcycle is equipped with a cowl among various kinds of cowls and then the motorcycle travels in a high speed range, there is a possibility that the wake stabilizer cannot manage the flow or the strength of the winds acting on the helmet. Thus, it cannot be said that the wake stabilizer is considered to improve the driving stability of the motorcycle under all circumstances in which the motorcycle can travel.

BRIEF SUMMARY OF THE INVENTION

Here, one or more embodiments of the present invention is developed by considering the aforementioned problems of the prior arts, and intends to provide an aerodynamic control device and a helmet including the same so as to be able to further decrease the drag, the lift, and the side force and further improve the driving stability even under various circumstances generated by with or without a cowl, changing the shape of a cowl and the super high speed riding.

In order to solve the aforementioned problems, according to one or more embodiments of the present invention, provided is an aerodynamic control device having a void opening in order to decrease the turbulence resistance generated by a component part located behind the center of a longitudinal width of a helmet and protruded backward from the helmet. The aerodynamic control device of one or more embodiments of the present invention is a device which encourages the decrease of the air resistance owing to the void opening that increases the air flow channel. That is, the void opening serves as an inlet of another air flow channel and has a configuration as like as a through-hole, an opening of a pipe, or a groove tip and so on.

Further, according to the aerodynamic control device of one or more embodiments of the present invention, the aerodynamic control device includes a rear spoiler (which is a device attached to the rear portion of the helmet or integrated with the rear portion of the helmet so as to protrude toward the rear side of the helmet and is mainly used to keep the stability of the helmet) and a thin plate member that is adjacent to the rear spoiler. A positional relation between the rear spoiler and the thin plate member may be set so that both members are disposed in parallel and front-back direction or, overlap each other in upper-lower direction.

Further, the number of the thin plate members may be plural. Thus, a space between the rear spoiler and the thin plate member or a gap or gaps between the thin plate members in the case of two or more thin plate members may be served as a void opening. Further, a void opening such as a through-hole may exist in any one of or both the rear spoiler and the thin plate members. Of course, both the gap and the through-hole can be existed at the same time. Additionally, the area or the number of the thin plate member or the area or the number of the void opening can be determined freely as long as the same aerodynamic effect can be obtained relatively.

Then, according to the aerodynamic control device of one or more embodiments of the present invention, the thin plate member may be disposed behind a rear end portion of the rear spoiler.

That is, this enables to obtain the same rectification effect as in case of extending the rear spoiler backward because the thin plate member is located behind the rear spoiler end.

Further, the thin plate member may be bonded to the rear spoiler or, fixed alone onto the helmet with an interval from the rear spoiler.

Further, according to the aerodynamic control device of one or more embodiments of the present invention, the void opening may be a slit shaped as an elongated hole or a narrow line.

Further, according to the aerodynamic control device of one or more embodiments of the present invention, the thin plate member may be an independent accessory part which is detachable from and attachable to the rear spoiler and/or the helmet, instead of a component part molded integrally into the rear spoiler.

Then, in order to solve the aforementioned problems, according to one or more embodiments of the present invention, provided is a helmet with an aerodynamic control device that consists of the rear spoiler which is Mimed behind a center of a longitudinal width of a helmet so that one end of the rear spoiler is connected to the helmet and the other end protrudes backward from the helmet, a thin plate member which is adjacent to the rear spoiler, and a void opening which decreases a turbulence resistance generated by the rear spoiler.

Further, according to the helmet of one or more embodiments of the present invention, the aerodynamic control device is formed so that the thin plate member is disposed behind a rear end portion of the rear spoiler.

Further, according to the helmet of one or more embodiments of the present invention, the void opening is may be a slit shaped an elongated hole or a narrow line.

Then, according to the helmet of one or more embodiments of the present invention, a flow passage may be formed on the backside of the helmet in order to release a wind flowing through the void opening from the helmet to backward. As described above, since the void opening serves as an inlet of another air flow channel, this flow passage can also has a configuration as like as a through-hole, an opening of a pipe, or a groove tip and so on.

According to one or more embodiments of the present invention, it is possible to obtain the aerodynamic control device and the helmet including the same capable of further decreasing the drag, the lift, and the side force and further improving the driving stability even under various circumstances.

BRIEF DESCRIPTION OF THE DRAWINGS

FIG. 12 is a diagram illustrating a difference in aerodynamic characteristic of the helmet before and after the aerodynamic control device according to the embodiment is attached to the helmet.

DETAILED DESCRIPTION OF THE INVENTION

The air flow along a side surface of a helmet generates a turbulence behind a portion in which the horizontal width of the helmet becomes maximum, that is, the center position of the helmet in front-back direction. Particularly, when a protrusion exists at this position, the turbulence increases further. Such a protrusion includes a ventilator, a rear spoiler, a communication device, and so on. An aerodynamic control device of one or more embodiments of the present invention can be composed by a void opening provided on the protrusion itself or the adjacent position thereto.

It is because a part of the turbulence is removed from the involved surface by the void opening. Further, as described above, when the aerodynamic control device of one or more embodiments of the present invention is applied to the rear spoiler frequently mounted on the current helmets, the drag, the lift, and the side force acting on the helmet can be decreased further.

Figure 1:
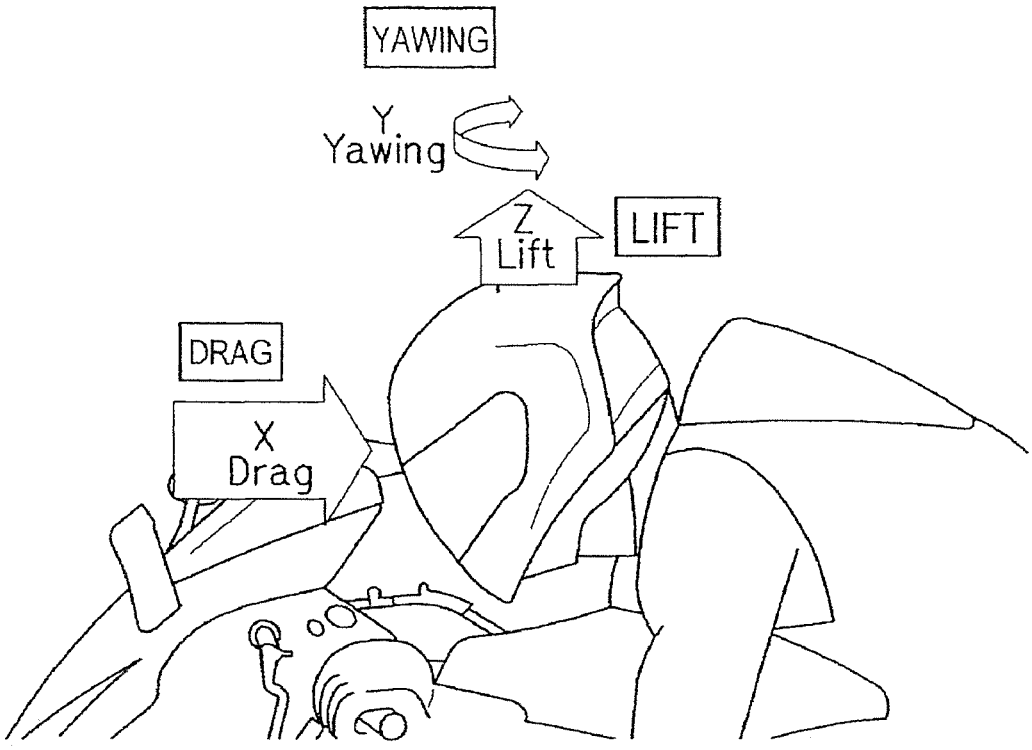
FIG. 1 is a view illustrating a relation among drag, side force (yawing), and lift acting on a helmeted rider riding a motorcycle.
Figure 2:
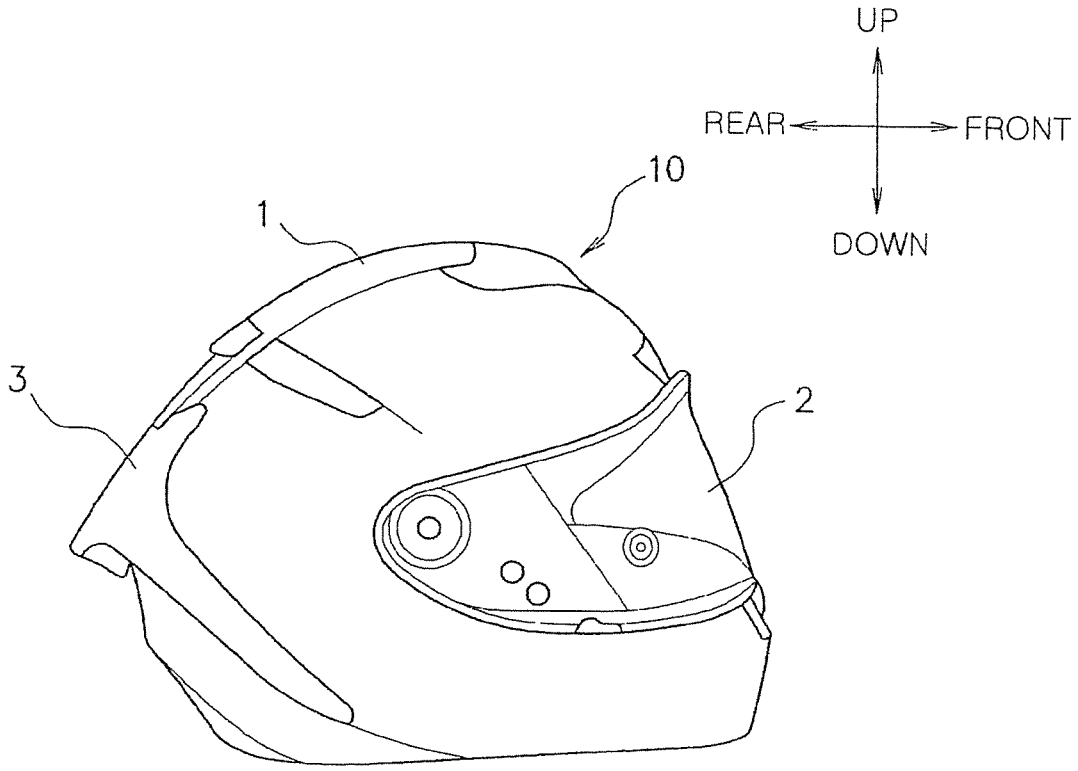
FIG. 2 is a right side view illustrating an entire helmet without an aerodynamic control device according to an embodiment.

First, an entire helmet without the aerodynamic control device according to the embodiment is described. FIG. 2 is a right side view illustrating an entire helmet without the aerodynamic control device according to the embodiment.

In FIG. 2, a helmet 1 for a motorcycle rider according to the embodiment has a streamline shape in the front and rear direction and is equipped with a shield 2 covering a front widow as a field of view of the rider in a detachable and attachable manner. This shield 2 is molded by synthetic resin (for example, polycarbonate) which is a light transmissivity and rigid. Then, the helmet 1 is mounted a rear spoiler 3 in order to generate a down force which counteracts a lift arose by the wind blowing to the rider in a traveling state. The rear spoiler 3 is located behind the center of the longitudinal width of the helmet 1 and is formed so that one end is connected to the helmet 1 and the other end protrudes backward from the helmet 1.

The rear spoiler 3 decreases vastly the air resistance above the helmet, but the air at the left and right side surfaces cannot be decreased so much as we expected. It is because the wind flowing along the left and right side surfaces is not made up only by the wind blowing from the front side, but also the wind rolling up from the lower side of the helmet 1 (the lower side of a neck of the rider). In order to decrease those turbulence flows generated on the helmet surface, the aerodynamic control device according to the embodiment can be equipped at an arbitrary position on the rear spoiler 3.

That is, in order to support the rear spoiler, an accessory part being a wing shape as like as the rear spoiler should be disposed on the helmet. In the aerodynamic control device according to the embodiment, a thin plate member is used. Additionally, the position of the thin plate member with respect to the rear spoiler 3 may be disposed at an arbitrary position so as to decrease the turbulences. Thus, a plurality of the thin plate members may be disposed. When the thin plate members are disposed in parallel in the rear spoiler 3, any one of these members may be disposed at the front or the rear sides of the helmet 1. Further, these members may be disposed to overlap one another in upper-lower direction.

Further, a gap between the thin plate member and the rear spoiler or, a gap or gaps between the thin plate members can be formed as a void opening. In addition, a through-hole may be provided in the thin plate member and/or the rear spoiler.

Additionally, in the followed drawings, the forward arrow indicates the traveling direction of the motorcycle, the backward arrow indicates the direction opposite to the traveling direction, the left and right arrows indicate the left and right direction in the traveling direction and the direction perpendicular to the traveling direction, and the up and down arrows indicate the up and down direction in the traveling direction and the direction perpendicular to the traveling direction.

Figure 3:
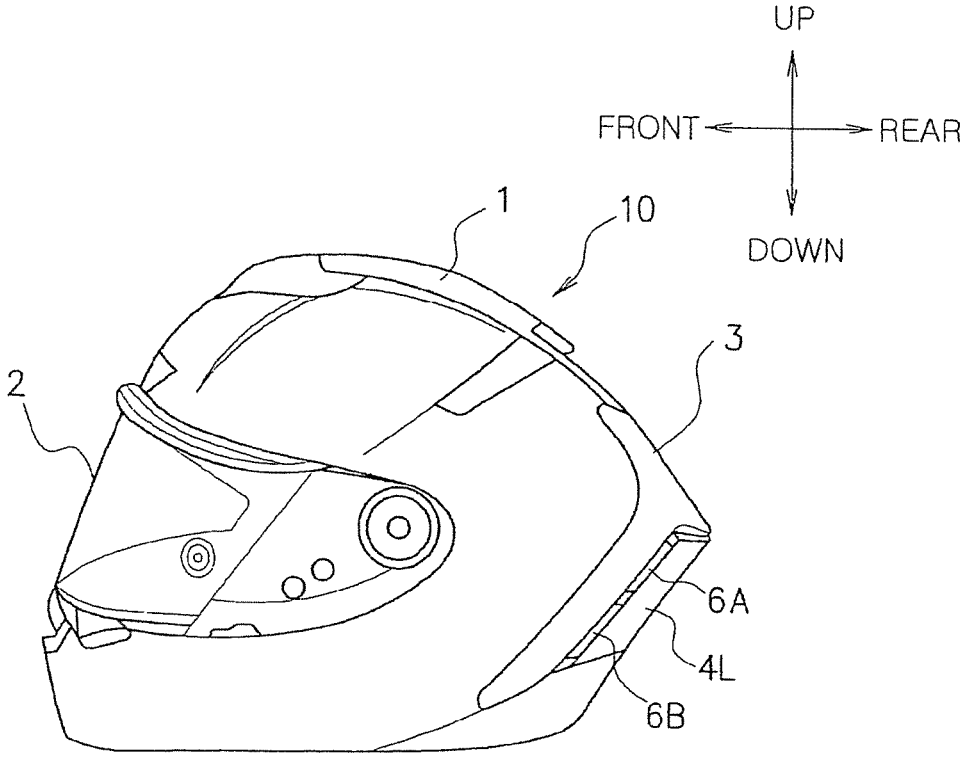
FIG. 3 is a left side view illustrating an entire helmet with the aerodynamic control device according to the embodiment.

Next, an entire helmet with the aerodynamic control device according to the embodiment is described. FIG. 3 is a left side view illustrating an entire helmet with the aerodynamic control device according to the embodiment.

Figure 6:
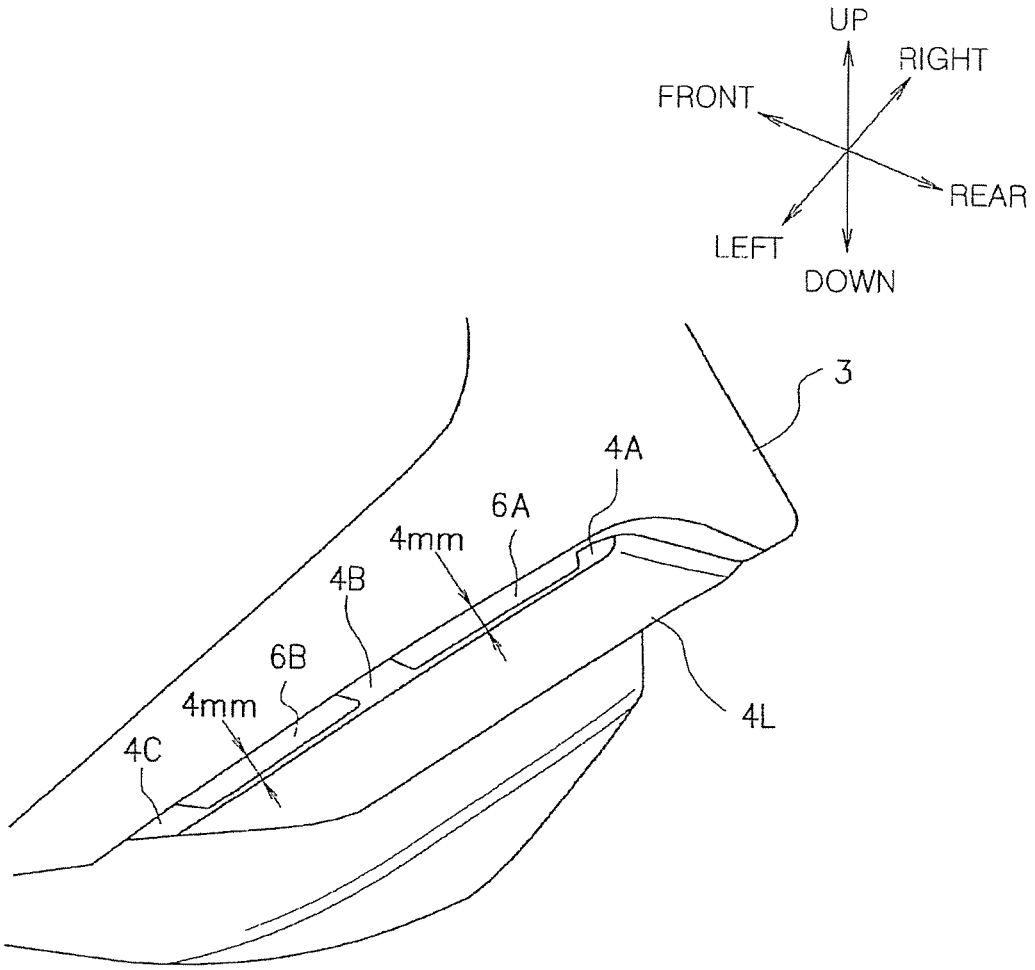
FIG. 6 is a main enlarged view when seen from the left rear side in a state where the aerodynamic control device is attached to the left side surface of the helmet according to the embodiment.

Further, a main part of the aerodynamic control device according to the embodiment attached to the left side surface of the helmet when seen from the left rear side is described. FIG. 6 is an enlarged view of a main part of the aerodynamic control device according to the embodiment attached to the left side surface of the helmet when seen from the left rear side.

In FIGS. 3 and 6, a thin plate member 4L as an example of the aerodynamic control device protrudes toward the rear side of the helmet 1 from the rear end portion of the left side of the rear spoiler 3, as well as forms the predetermined void openings 6A and 6B with the rear end portion. That is, the thin plate member 4L forms the void openings (slits) 6A and 6B with the left rear end portion of the rear spoiler 3. Since the void openings (slits) 6A and 6B work as new air flow channels, it is possible to prevent from accumulating the turbulent wind on the left side surface of the rear spoiler 3.

Further, since a released position where the wind flowing along the left side surface of the rear spoiler 3 is separated from the surface of the helmet 1 is displaced backward by the width of the thin plate member 4L, a turbulence vortex or a Karman vortex generated at the back side of the helmet is kept further away from the helmet. That is, it decreases the force acting on the rear portion of the rear spoiler 3.

In FIG. 6, the void opening (slit) formed between the end portion of the rear spoiler 3 and the thin plate member 4L is divided substantially into the elongated holes 6A and 6B by the joint segments (bosses) 4A, 4B, and 4C. Further, when the thin plate member 4L is disposed above or below the upper surface of the rear spoiler 3, a slit shaped a narrow line can be formed between two plates, instead of elongated hole. Additionally, in the embodiment, one piece of thin plate member is used, but a plural piece of thin plate members can be disposed so that each space between them serves as the void opening (slit).

Further, in FIG. 6, the void opening (slit) may be arranged freely related to the position or the number of the thin plate member 4L and/or the number or the size of the elongated hole based on the entire shape or the usage condition of the helmet. That is, the area or the number of the thin plate member and/or of the void opening (slit) can be arranged freely so as to obtain the same effect relatively. For example, when the area is halved, the number thereof may be increased twice.

But the desirable position of the thin plate member 4L should be at the end portion of the left side surface of the rear spoiler 3 if you need a displacement effect shifting backward the released position where the wind flowing along the left side surface of the helmet 1 is separated from the surface of the helmet 1. Further, when the number of the joint segments (bosses) 4A, 4B, and 4C is decreased, that is, the boss (pillar) is removed or the thickness of the joint segments (boss) is thinned, the area of the void opening (slit) can be increased. In this regard, the number and the thickness of the joint segments (boss) can be arranged arbitrarily in consideration of a balance between the fitting strength of the thin plate members 4L and 4R and a decrease effect in drag, lift, and side force.

Additionally, FIGS. 3 and 6 show an example in which the thin plate member 4L is attached to the left end portion of the rear spoiler 3, but the thin plate member 4R similar to 4L, is also attached naturally to the right end portion of the rear spoiler 3.

Figure 7:
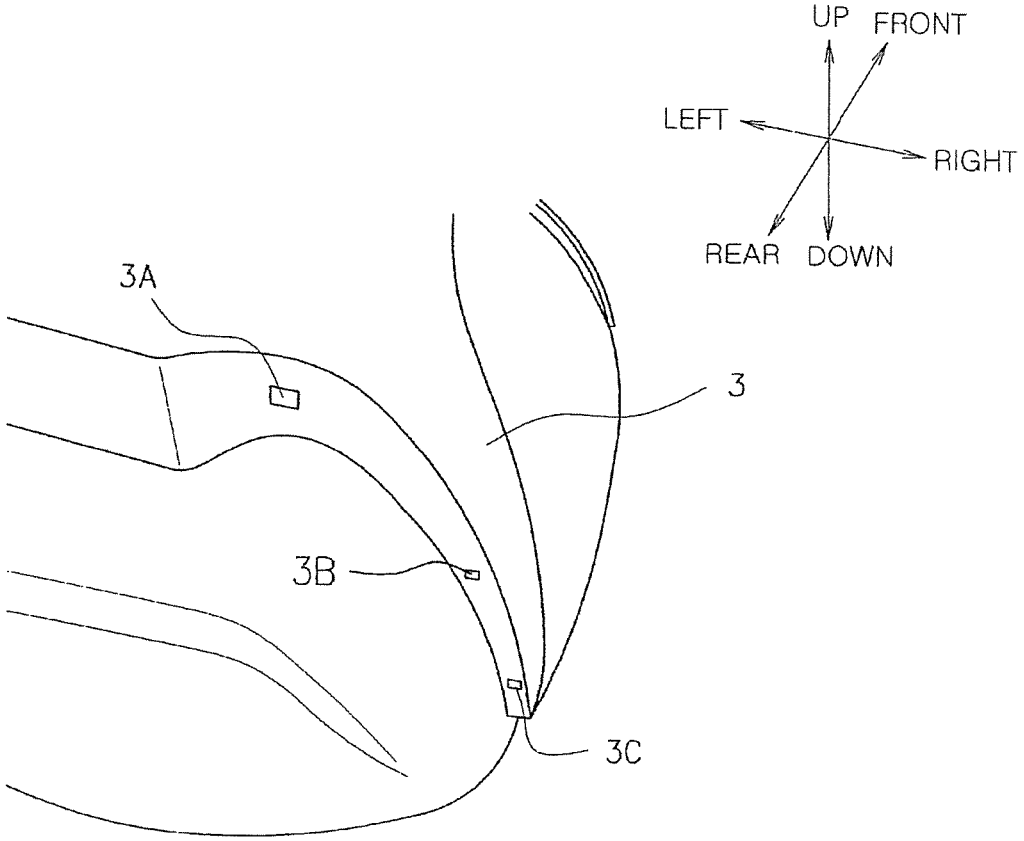
FIG. 7 is a main enlarged view when seen from the right rear side in a state before the aerodynamic control device is attached to the right side surface of the helmet according to the embodiment.
Figure 8:
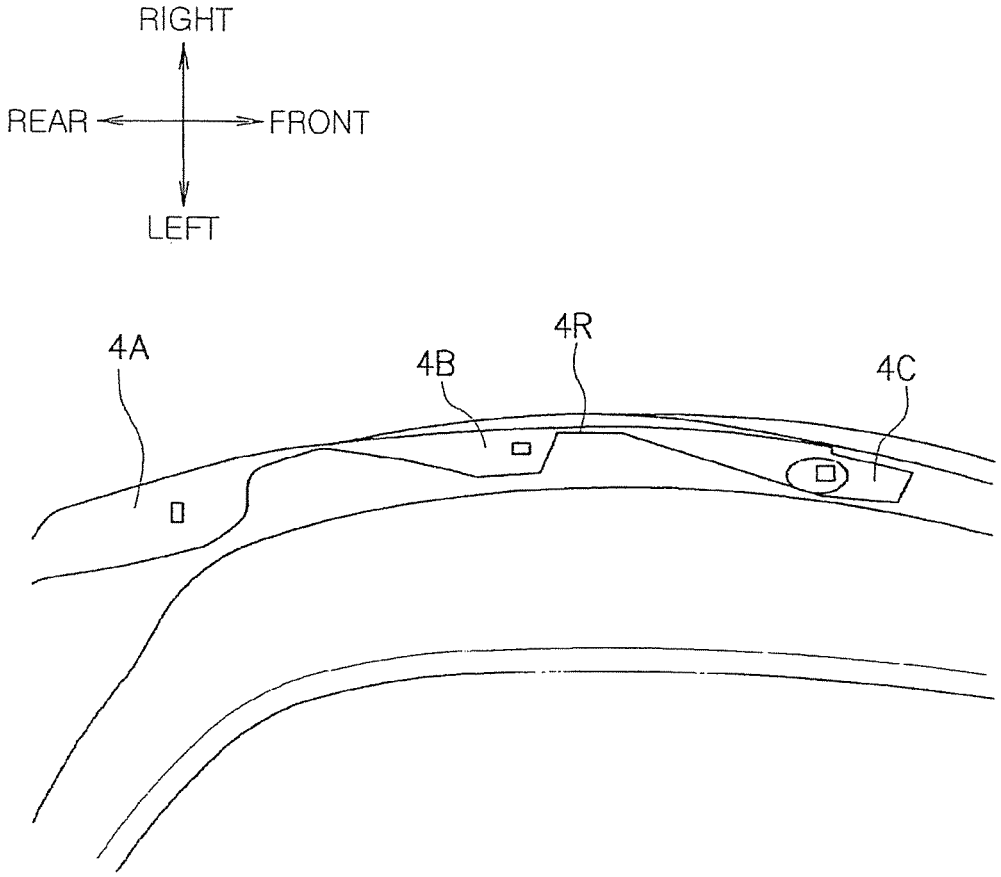
FIG. 8 is a main enlarged view when seen from a bottom surface of the helmet in a state where the aerodynamic control device according to the embodiment is attached to the right side surface of the helmet.

Next, a main part of the right side surface of the helmet according to the embodiment without the aerodynamic control device when seen from the right rear side, and a main part of the aerodynamic control device according to the embodiment which has been attached to the right side surface of the helmet when seen from the bottom surface of the helmet are described. FIG. 7 is a main enlarged view of the right side surface of the helmet according to the embodiment when seen from the right rear side, before the thin plate member 4R is attached. Further, FIG. 8 is also the main enlarged view when seen from the bottom surface of the helmet, after the thin plate member 4R has been attached to the right side surface of the helmet.

Figure 9:
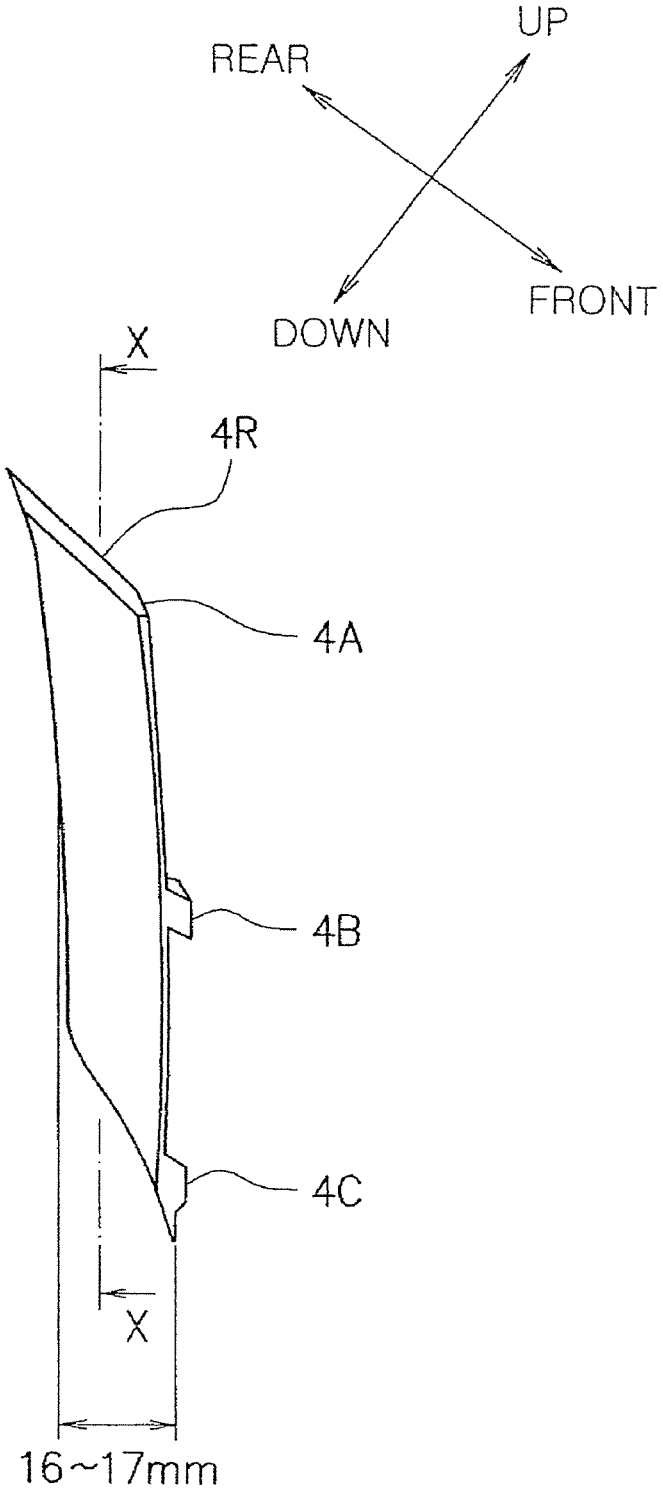
FIG. 9 is a front view illustrating the aerodynamic control device attached to the right side surface of the helmet according to the embodiment.
Figure 10:
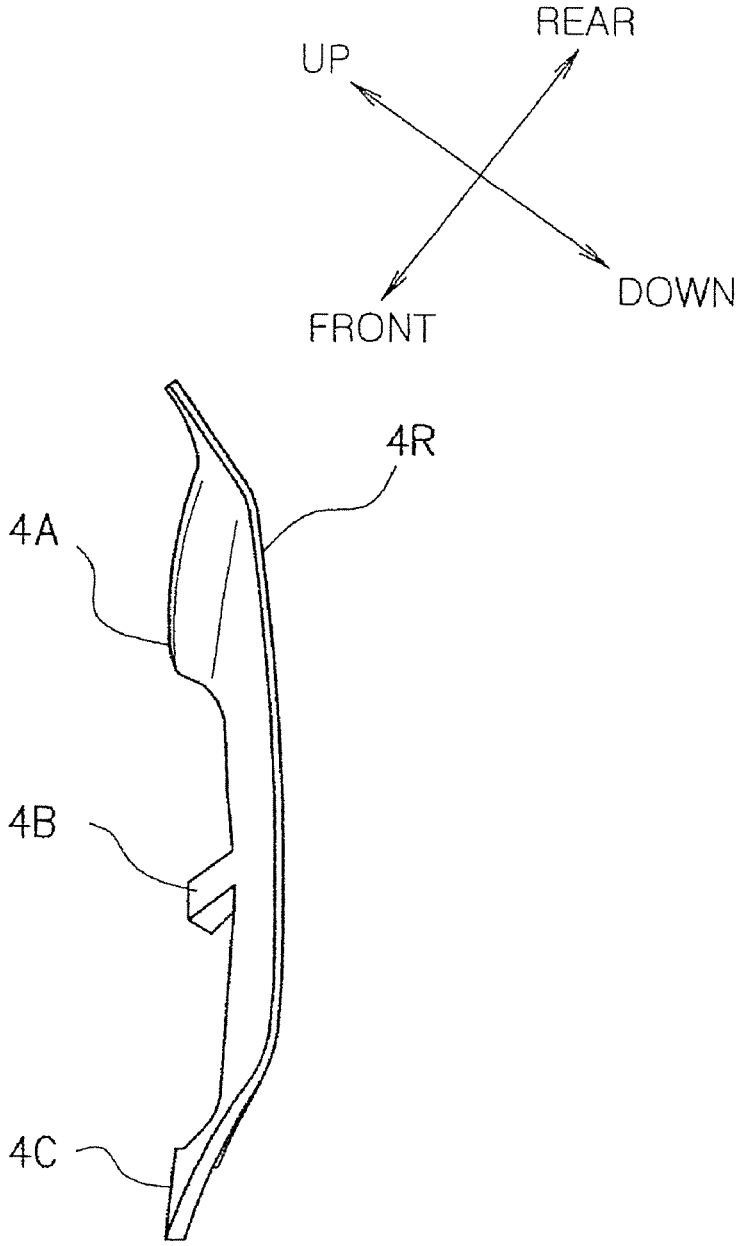
FIG. 10 is a rear view illustrating the aerodynamic control device attached to the right side surface of the helmet according to the embodiment.

Further, the aerodynamic control device for attaching to the right side surface of the helmet according to the embodiment is described. FIG. 9 is a front view of the aerodynamic control device for attaching to the right side surface of the helmet according to the embodiment. Further, FIG. 10 is a rear view of the aerodynamic control device for attaching to the right side surface of the helmet according to the embodiment. Then, FIG. 11 is a view of the aerodynamic control device for attaching to the right side surface of the helmet according to the embodiment when seen from the direction X-X of FIG. 9.

Figure 11:
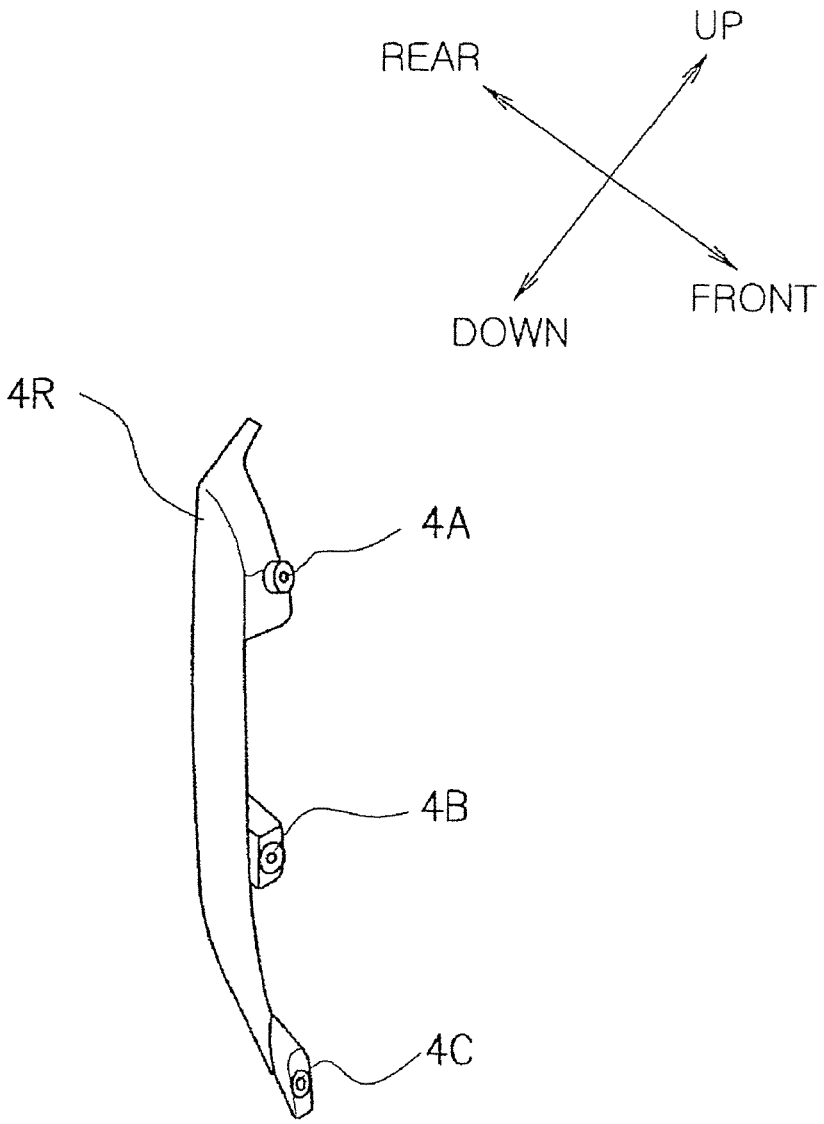
FIG. 11 is a view in which the aerodynamic control device attached to the right side surface of the helmet according to the embodiment is seen in the direction X-X of FIG. 9.

Then, as illustrated in FIGS. 7 to 11, the thin plate member 4R is not integrally molded with the rear spoiler 3 and is an independent accessory part which is detachable from and attachable to the rear spoiler 3. First, in FIG. 7, the end portion of the rear spoiler 3 is provided with holes 3A, 3B, and 3C. Then, as illustrated in FIGS. 9 to 11, the thin plate member 4R is provided with the joint segments (boss) for fastening to the holes 3A, 3B, and 3C of the rear spoiler 3. As a screw fastens each boss on each hole, it is detachable and attachable. Additionally, in FIG. 9, the width dimension of the thin plate member 4R is described "16 to 17 mm" as a testing condition on a wind tunnel experiment.

In this way, since the thin plate member 4R is detachable and attachable, the thin plate member can be replaced even when the thin plate member is broken. Further, since the thin plate member can be attached to the existing rear spoiler, it is possible to improve the aerodynamics (aerodynamic resistance) of the helmet and to add the thin plate member as an option part. In addition, since the area of the opening (slit) is changed by taking a different attachment angle of the thin plate member against the rear spoiler, the amount of the wind flow into the opening (slit) can be adjusted. Further, the thin plate member having a different width dimension can be also replaced. That is, when plural types of the thin plate members are prepared, the corresponding thin plate member can be replaced and used in accordance with the riding circumstances of the motorcycle.

Additionally, FIGS. 7 to 11 show an example in which the thin plate member 4R is fastened to the right end portion of the rear spoiler 3, but the thin plate member 4L, similar to 4L, is also fastened naturally to the left end portion of the rear spoiler 3. Further, in this embodiment, a method of fastening the joint segments (boss) of the thin plate member 4R to the holes 3A, 3B, and 3C perforated in the rear spoiler 3 has been described, but the joint segments (boss) may be provided conversely on the rear spoiler 3.

Further, in this embodiment, an example method by a screw for fixing the thin plate member 4R to the rear spoiler 3 has been described, but the fixing method is not limited to the screw. Of course, an arbitrary method including a hook, a fastener, adhering, and welding can be used.

Figure 4:
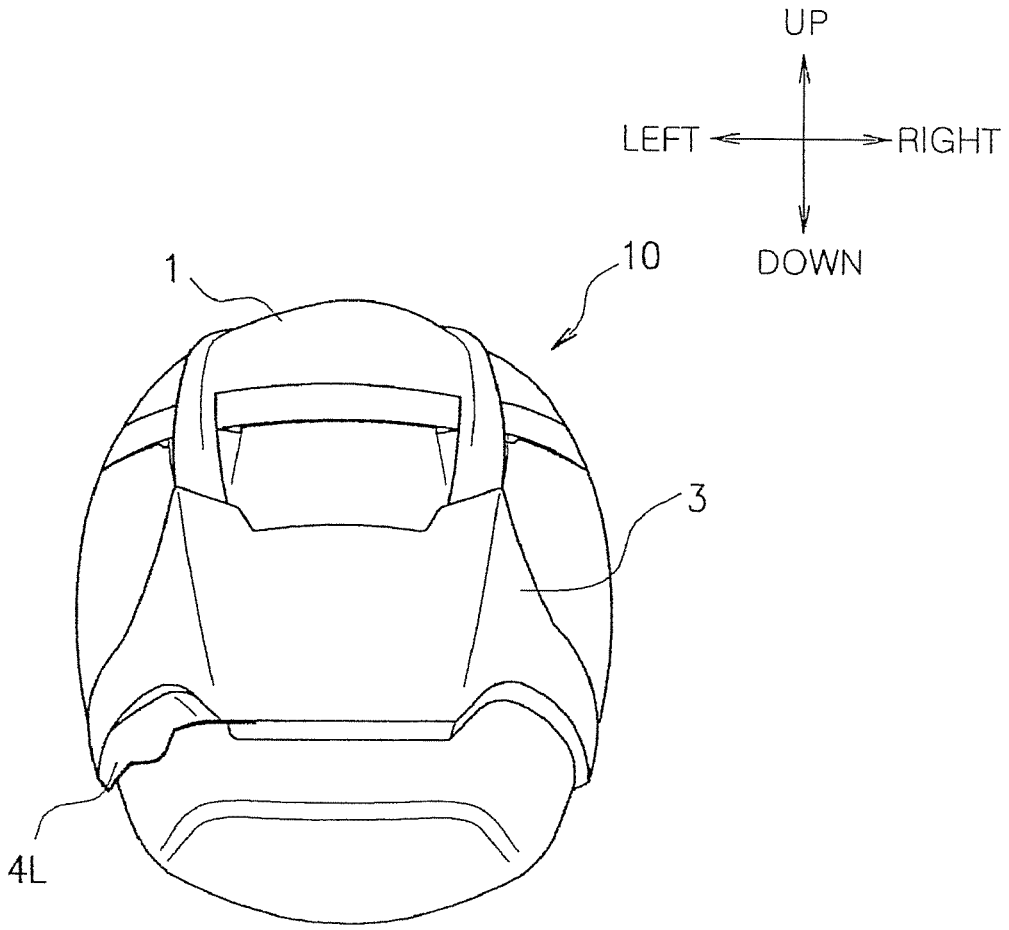
FIG. 4 is a rear view illustrating an entire helmet in which the aerodynamic control device is attached to a left side surface of the helmet according to the embodiment and the aerodynamic control device is not attached to a right side surface thereof.

Next, an entire helmet according to the embodiment is described in case that the aerodynamic control device is equipped to only the left side surface of the helmet, while the aerodynamic control device is not equipped to the right side surface. FIG. 4 is a rear view of the entire helmet according to the embodiment in case that the aerodynamic control device is equipped to the left side surface of the helmet and not equipped to the right side surface.

As illustrated in FIG. 4, the thin plate member 4L is adjacent to the left side surface of the rear spoiler 3 on the helmet so as to form the void opening between them. However, the thin plate member 4L can be disposed in various ways against the rear spoiler 3 as described above. Additionally, FIG. 4 shows an example in which the thin plate member 4L is attached to the left end portion of the rear spoiler 3, but the thin plate member 4R, similar to 4L, is also attached naturally to the right end portion of the rear spoiler 3.

Figure 5:
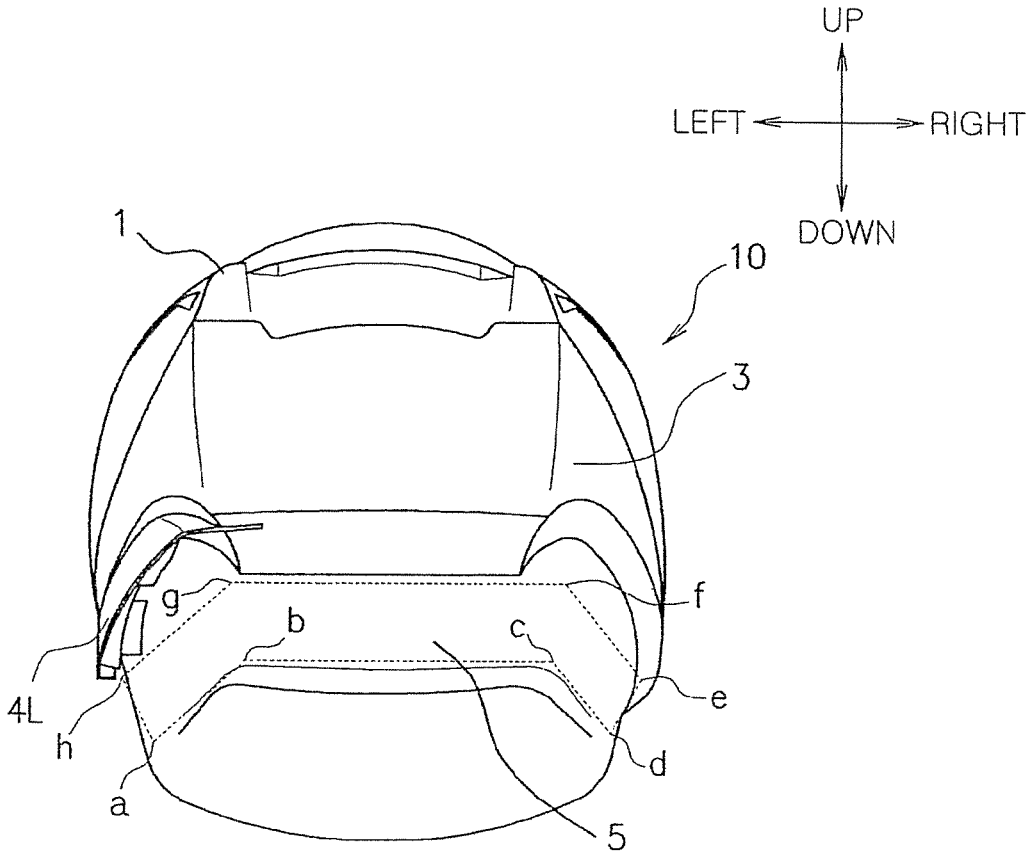
FIG. 5 is a rear view illustrating an entire helmet in which a depressed step portion is formed on the backside of the helmet according to the embodiment.

Next, an entire helmet in which a depressed step portion is formed on the rear portion of the helmet according to the embodiment is described. FIG. 5 shows a rear view of the entire helmet when a depressed step portion 5 is formed on the backside of the helmet of FIG. 4.

In FIG. 5, the depressed step portion 5 dented by a predetermined depth from the surface of the helmet 1 is formed in an area surrounded by two dotted lines in which one line starts from the left nape portion of the rider (a), extends obliquely right upward to (b), parallels the left and right direction on the rear portion toward (c), falls obliquely downward and reaches the right nape portion of the rider (d), and another line extends obliquely left upward from the lower end portion (e) to the upper end portion (f), on the rear side of the thin plate member 4R which is not illustrated, parallels the left and right direction on the rear end portion of the rear spoiler 3 toward (g), falls obliquely downward along the rear side of the thin plate member 4L and reaches the lower end portion (h) of the thin plate member 4L.

Wind passing through the void openings (slits) 6A and 6B of the thin plate member 4L blows against the surface of the helmet 1 and bounces toward the thin plate members 4L or 4R again. That is, a turbulent vortex is generated at the back side of the thin plate members 4L and 4R. This turbulent vortex serves a resistance force for the helmet as Drag. The depressed step portion 5 can function as a flow passage in order to release the wind passing through the void openings (slits) 6A and 6B from the helmet 1 and suppresses the generation of the turbulent vortex. As a result, the resistance force acting on the helmet as Drag is decreased.

Thus, such a flow passage needs to be disposed near the void opening (slit). Particularly, it is desirable that the flow passage is located at the place where the wind ejected from the void opening (slit) blows the helmet surface. Additionally, in this embodiment, the flow passage is formed as a groove by the depressed step portion 5 (concave portion), but may be formed in a pipe shape (cylindrical shape) and so on.

Next, a difference in aerodynamic characteristic of the helmet without and with the aerodynamic control device according to the embodiment is described. FIG. 12 shows a difference in aerodynamic characteristic of the helmet before and after the aerodynamic control device according to the embodiment is attached.

First, a test condition of the wind tunnel experiment is described. In a wind tunnel experiment facility owned by the applicant, an experiment apparatus equipped with a vehicle body (motorcycle) and a robot supporting a dummy body and a dummy head was used. Then, the forces acted on the dummy head were measured. Additionally, in this wind tunnel experiment, the thin plate members 4L and 4R had a width of between 16 mm and 17 mm, and the void openings (slits) 6A and 6B formed between the rear spoiler 3 and the thin plate members 4L and 4R had a width of 4 mm. So, the surface area of each of the thin plate members 4L and 4R with respect to the surface area of the void openings (slits) is about 5.7 times.

On the condition of the wind speed set 160 km/h (about 44.4 meter/second) and the dummy head at an angle of 21.1 degrees, an experiment was conducted for a conventional helmet without the aerodynamic control device according to the embodiment (without the thin plate wings) and a helmet with the aerodynamic control device according to the embodiment (with the thin plate wings).

Each average value of three component forces was calculated from the measurement data of 3000 logs for 300 seconds. Additionally, the measurement values for the drag, the lift, and the rotational force (side force) were corrected by the standard condition which consisted of an atmospheric pressure of 1013.25 hPa, a temperature of 20° C., and a humidity of 40%. Then, it is considered how the drag, the lift, and the rotational force (side force) were improved in comparing the helmet with the aerodynamic control device according to the embodiment with one without the aerodynamic control device according to the embodiment.

As a result of this experiment, the helmet with the aerodynamic control device according to the embodiment could decrease the drag by 99 g, the lift by 132 g, and the rotational force (side force) by 60 g. So, those results are realized that all of the drag, the lift, and the rotational force (side force) were improved. Thus, it is possible to mention that there is an effect of keeping a stable posture without shaking the helmet left and right even in a high-speed range by using the aerodynamic control device according to the embodiment.

Here, an additional explanation is provide about the width dimensions of the void openings (slits) 6A and 6B formed between the rear spoiler 3 and the thin plate members 4L or 4R, as well as one of each of the thin plate members 4L and 4R. Regarding the width dimensions of the void openings (slits) 6A and 6B between the rear spoiler 3 and the thin plate members 4L and 4R, while the numerical values of the drag, the lift, and the side force are changed depending on the various size of the void opening (slit), but there is a critical point in those values for decreasing the drag, the lift, and the side force to certain extent.

Further, if the width dimension of each of the thin plate members 4L and 4R becomes larger, the drag will decrease, but the lift will increase. Additionally, if the width dimension of each of the thin plate members 4L and 4R becomes larger, or, if the additional thin plate members are attached to the rear end portion of the thin plate members 4L and 4R on the rear side of the helmet 1 so as to faun the predetermined void openings (slits) between them (a configuration in which the plurality of thin plate members are attached to the left and right thin plate members), or if the left and right side surface ends of the rear spoiler 3 are extended backward from the rear side of the helmet 1 without the thin plate members and a void opening (elongated hole) having a predetermined area is formed at a predetermined position of the rear spoiler 3, the side force will also increase and hence the rider cannot turn his face to the lateral direction.

In the embodiment, it is possible to obtain the aerodynamic control device and the helmet including the same, that improves the drag, the lift, and the side force by changing the parameters which are the size of the void opening (slit) between the rear spoiler and the thin plate member, the width dimension of the thin plate member, and the ratio of the surface area of the thin plate member with respect to the surface area of the void opening (slit) in order to further decrease the drag, the lift, and the side force and further improve the riding stability even under various circumstances generated by with or without the cowl, changing the shape of the cowl and the traveling in an super high-speed range.

In conclusion, it is found that a measurable improvement of the aerodynamic characteristics is obtained by the presence of at least a void opening (slit) between the rear spoiler and the aerodynamic control device. Then, as described above, since the problem that the side force increases will be occurred if the aerodynamic control device is extremely enlarged, the aerodynamic control device should have a feasible and realistic size as an industrial product.

For example, the conventional helmet with a rear spoiler, which is structured as one component and integrated with the helmet, need to increase the size of the rear spoiler in order to improve the aerodynamics characteristics of the drag, the lift, and the side force. So, it will also cause the problem that the side force increases as described above. For this reason, there is a demand for obtaining the improvement of the aerodynamic characteristic without increasing the size of the rear spoiler as much as possible.

Further, it offers an advantage of easily designing the helmet for improving the aerodynamic characteristics such as the drag, the lift, and the side force, to conduct the experiment of changing the parameter of the independent member which is a distinct component from the rear spoiler and is attached to the rear spoiler which has a fixed parameter, in comparison with the experiment of changing the parameter of the rear spoiler itself. Further, the former composition including the independent member and the rear spoiler offers more flexible design than the latter composition in viewpoint of painting, forming, and molding the helmet. Thus, the void opening (slit) is provided between the rear spoiler and the aerodynamic control device, instead of increasing the size of the rear spoiler.

However, in order to obtain the equal aerodynamic characteristics with the latter composition based on the design values of the former composition, at least a void opening (slit) for releasing a traveling wind should be provided on each side surface of the rear spoiler, which is attached to the rear portion of the helmet or integrated with the rear portion of the helmet.

Then, in the experiment of the embodiment, a satisfactory result was obtained on the condition that the dimension of the void opening (slit) between the rear spoiler and the thin plate member was about 4 mm, the width dimension of the thin plate member was between 16 mm and 17 mm, and the relative ratio between the surface area of the void opening (slit) and the surface area of the thin plate member was about 1 to 5.7. Further, in the additional experiment conducted by the applicant, a satisfactory result was also obtained even when the width dimension of the thin plate member was between 10 mm and 12 mm. From those experiment results, it is a desirable condition that the relative ratio between the surface area of the void opening (slit) and the surface area of the thin plate member is set up a range from 1 to 3 to 1 to 6.

In this way, in the embodiment, the aerodynamic control device is attached to the conventional helmet with an integrated rear spoiler so as to form the predetermined void openings (slits) having a predetermined size between them in order to further improve the stability of the motorcycle driving at a super high speed. This makes it possible to further decrease the drag, the lift, and the side force in the super high-speed driving and to obtain an innovative design. Thus, it is possible to obtain the aerodynamic control device and the helmet including the same which can further decrease the drag, the lift, and the side force and further improve the driving stability even under various circumstances generated by with or without the cowl, changing the shape of the cowl, or the driving in the super high-speed range.

The conventional rear spoiler equipped with the helmet existing in the market serves also a function as a stabilizer for stabilizing the driving position of the rider. However, it is obviously that the aerodynamic control device according to the embodiment is more advantageous and offers larger effect than the conventional rear spoiler in some aerodynamic characteristics. From the past, the aerodynamic control component such as a rear spoiler has been provided for the racing helmets. However, the aerodynamic control device according to one or more embodiments of the present invention and the helmet including the same can be obtained by pursuing the higher aerodynamic characteristics.

Additionally, in the aforementioned embodiment, while the motorcycle helmet as a representative example product has been described, but one or more embodiments of the present invention can be also applied to other products except for this.

In one or more embodiments of the present invention described above, the void opening (slit) for releasing the traveling wind is provided on the right side surface and the left side surface of the rear spoiler which is equipped or, integrated with the rear portion of the helmet. Thus, according to one or more embodiments of the present invention, it is possible to obtain the aerodynamic control device and the helmet including the same which can further decrease the drag, the lift, and the side force and further improve the riding stability even under various circumstances generated by with or without of the cowl, changing the shape of the cowl and the driving in the super high-speed range.

While one or more embodiments of the present invention has been described so far, one or more embodiments of the present invention is not limited to the aforementioned embodiments. That is, one or more embodiments can be modified as the other embodiments or addition, modification, and omission can be made within the scope set by the person skilled in the art. Then, any one of these is also included in the scope of the present invention as long as the operation and effect of the present invention is obtained.

What is claimed is:

1. An aerodynamic control device on an outer surface of a helmet, the aerodynamic control device comprising:

a rear spoiler located behind a center of a longitudinal width of the helmet, protruding backward from the helmet and extending behind the helmet;

a first thin plate member and a second thin plate member, disposed at a left rear side and a right rear side of the helmet respectively; and a void opening disposed behind the helmet, wherein the void opening is formed on the rear spoiler, the first and second thin plate members, or between the rear spoiler and the first and second thin plate members and adapted to decrease a resistance of turbulence generated by the rear spoiler, wherein the first and second thin plate members are not integrated with the rear spoiler and each of the first and second thin plate members is an independent part which is attachable to and detachable from the rear spoiler.

2. The aerodynamic control device according to claim 1, wherein the first and second thin plate members are connected to a rear end portion of the rear spoiler.

3. The aerodynamic control device according to claim 1, wherein the void opening is an elongated hole or a narrow lined slit.

4. The aerodynamic control device according to claim 2, wherein the void opening is an elongated hole or a narrow lined slit.

5. The aerodynamic control device according to claim 3, wherein the first and second thin plate members are not integrated with the rear spoiler but each of the first and second thin plate members is an independent part which is attachable to and detachable from the rear spoiler.

6. The aerodynamic control device according to claim 4, wherein the first and second thin plate members are not integrated with the rear spoiler and each of the first and second thin plate members is an independent part which is attachable to and detachable from the rear spoiler.

7. A helmet with an aerodynamic control device comprising:

a rear spoiler which is formed behind a center of a longitudinal width of the helmet so that one end is connected to the helmet and the other end protrudes backward from the helmet and extend behind the helmet, a first thin plate member and a second thin plate member respectively disposed at a left rear side and a right rear side of the helmet, and a void opening formed on the rear spoiler, the first and second thin plate members, or between the rear spoiler and the first and second thin plate members, which decreases a resistance of a turbulence generated by the rear spoiler, wherein the first and second thin plate members are not integrated with the rear spoiler and each of the first and second thin plate members is an independent part which is attachable to and detachable from the rear spoiler.

8. The helmet according to claim 7, wherein the aerodynamic control device is formed so that the first and second thin plate members are connected to a rear end portion of the rear spoiler.

9. The helmet according to claim 7, wherein the void opening is an elongated hole or a narrow lined slit.

10. The helmet according to claim 8, wherein the void opening is an elongated hole or a narrow lined slit.

11. The helmet according to claim 7, wherein a flow passage is formed on the backside of the helmet in order to release a wind flowing through the void opening of the helmet backward.

12. The helmet according to claim 8,
wherein a flow passage is formed on the backside of the helmet order to release a wind flowing through the void opening of the helmet backward.

13. The helmet according to claim 9,
wherein a flow passage is formed on the backside of the helmet in order to release a wind flowing through the void opening of the helmet backward.

14. The helmet according to claim 10,
wherein a flow passage is formed on the backside of the helmet in order to release a wind flowing through the void opening of the helmet backward.

* * * * *